US008146276B2

(12) United States Patent
Pan et al.

(10) Patent No.: US 8,146,276 B2
(45) Date of Patent: Apr. 3, 2012

(54) INSULATION COVER FOR IRON

(75) Inventors: Chien-Chih Pan, Tainan (TW); Lo Yi Lin, Tainan County (TW)

(73) Assignee: Tsann Kuen (Zhangzhou) Enterprise Co., Ltd., Zhangzhou (CN)

( * ) Notice: Subject to any disclaimer, the term of this patent is extended or adjusted under 35 U.S.C. 154(b) by 317 days.

(21) Appl. No.: 12/564,435

(22) Filed: Sep. 22, 2009

(65) Prior Publication Data

US 2010/0071235 A1 Mar. 25, 2010

(30) Foreign Application Priority Data

Sep. 22, 2008 (CN) ..... 2008 2 0145677 U

(51) Int. Cl.
*D06F 33/00* (2006.01)
*B65D 85/00* (2006.01)
*B65D 65/00* (2006.01)

(52) U.S. Cl. ..... 38/141; 206/320; 150/161; 150/165

(58) Field of Classification Search ..... 206/349; 150/161, 165; 38/74, 79, 88, 89, 95, 97, 38/141

See application file for complete search history.

(56) References Cited

U.S. PATENT DOCUMENTS

| | | | | |
|---|---|---|---|---|
| 2,074,159 | A * | 3/1937 | Bailey | 206/320 |
| 2,659,167 | A * | 11/1953 | Weldon | 38/97 |
| 2,743,542 | A * | 5/1956 | Drummond | 38/97 |
| 3,121,965 | A * | 2/1964 | McBride | 38/97 |
| 5,022,572 | A * | 6/1991 | Brown | 224/437 |
| 5,950,826 | A * | 9/1999 | Lykowski | 206/349 |
| 6,021,591 | A * | 2/2000 | Basile | 38/77.6 |
| 6,250,593 | B1 * | 6/2001 | Palu | 248/117.2 |
| 6,499,519 | B1 * | 12/2002 | Brown | 150/161 |
| 6,808,066 | B2 * | 10/2004 | Bean | 206/349 |

* cited by examiner

*Primary Examiner* — Ismael Izaguirre
(74) *Attorney, Agent, or Firm* — Rabin & Berdo, P.C.

(57) ABSTRACT

An insulation cover for iron comprises a bag-shaped body for containing the iron; the body is provided with an opening which is used as an entrance for the iron; the opening of the body is provided with a zip-fastener for closing the opening; the body is provided with a hanger. After the iron being placed into the body via the opening, zip up the opening, then the iron is covered inside the insulation cover and thus it can be placed on a horizontal surface directly; or be hanged with the cover by the hanger.

2 Claims, 3 Drawing Sheets

INSULATION COVER FOR IRON

FIELD OF THE INVENTION

The present invention relates to an accessory of iron.

BACKGROUND OF THE INVENTION

After being used, conventional electric irons can not be stored directly for their high temperature. And after returning to normal temperature, the iron only can be stored by placing on a horizontal surface, the way to storage is too simple. With the accelerating life rhythm, people need a simple cover to insulate the hot iron so as to store the iron rapidly.

SUMMARY OF THE INVENTION

Accordingly, the primary object of the present invention is to provide an insulation cover for iron, by which the hot iron can be stored directly therein, and can be stored by hanging besides the way of placing on a horizontal surface.

The object of the present invention is achieved by providing: an insulation cover comprising a main body provided with a hanger and an opening for containing the iron; said opening of said body is provided with a zip-fastener. After the iron is placed in the body via the opening, zip up the opening, then the iron is covered inside and thus can be placed on a horizontal surface directly. And the hanger is used to hang the insulation cover with the iron.

Said main body further comprises a concave bottom and a lid covered on said bottom; said lid is provided with a through hole for extending out the handle of the iron. The iron handle extending out from the through hole, which not only facilitate holding the iron in storage, but also facilitate the heat of the iron spreading out through the iron.

The rear portion of said bottom connected with the rear portion of the lid, and the zip-fastener connected the two sides and the front portion of said lid with the two sides and the front portion of said bottom, thus the opening is larger enough to allow the iron put into the body.

The hanger is disposed on the connected portion of said concave bottom and said lid, thus the stress state of the hanger, bottom and lid are reasonable.

The iron supporting surface of the concave bottom has a plurality of bumps or embossed strips 53, so that an interstice for containing air is formed between the iron and the bottom of the insulation cover to facilitate heat dissipation.

The insulation cover for iron of the present invention is provided with a zip-fastener to connected the opening of the body to form a container for containing the iron, and a hanger is disposed on the container, thus the hot iron can be stored directly or be hanged.

BRIEF DESCRIPTION FOR THE DRAWINGS

DETAILED DESCRIPTION OF THE PREFERRED EMBODIMENT

The body of the insulation cover of the present invention is bag-shaped for receiving iron; the body is provided with an opening which is used as an entrance for the iron; said opening of said body is provided with a zip-fastener for closing the opening; said body is provided with a hanger. After the iron has been placed in the body via the opening, zip up the opening, then the iron is covered inside the cover and thus it can be placed on a horizontal surface directly; or be hanged with the cover by the hanger.

Figure 1:
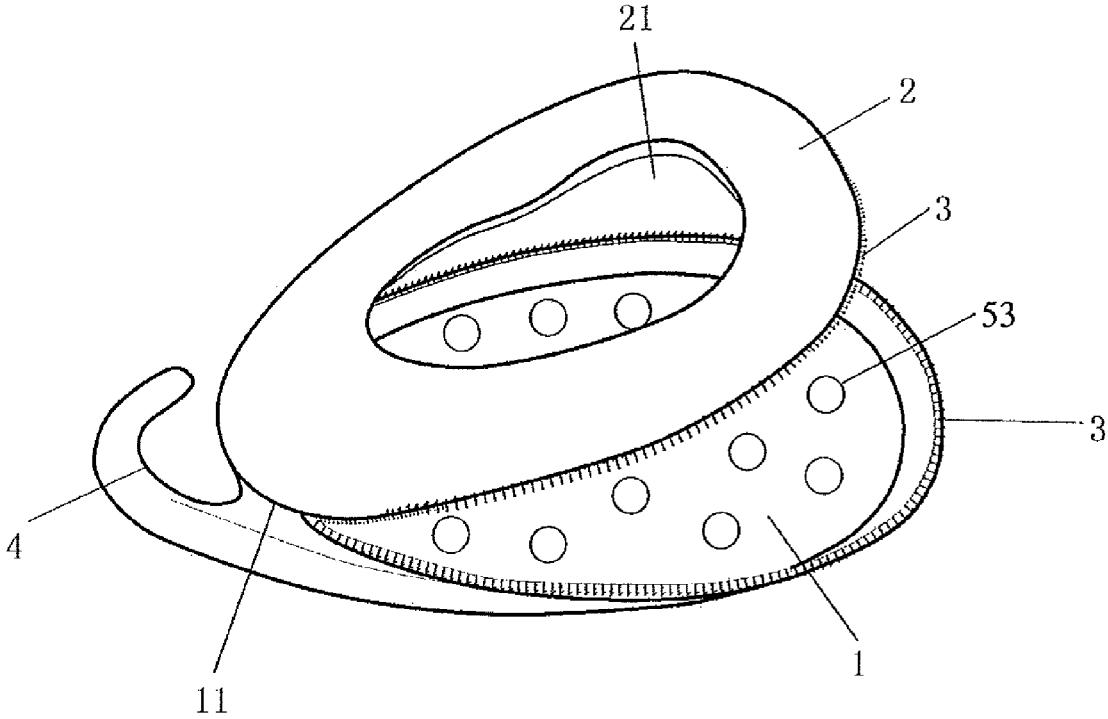
FIG. 1 is a perspective view of the insulation cover for iron of the present invention according to a preferred embodiment.

Referring to FIG. 1, which is a perspective view of the insulation cover for iron of the present invention according to a preferred embodiment. The insulation cover for iron is compression moulded by heat-resistant flexible plastic. The body has a concave bottom 1 and a sheet-shaped lid 2. The shape of the bottom 1 mates with the bottom 51 of the iron 5; and the periphery of the bottom extended upwardly to form a concave for receiving the iron 5.

Preferably, the iron supporting surface of the concave of said bottom 1 has a plurality of bumps or embossed strips 53, so that an interstice for containing air is formed between the iron and the bottom of the insulation cover to facilitate heat dissipation.

The rear portion 11 of the bottom 1 connected to the rear portion of the lid 2 and extending backwardly to form a hanger 4. Certainly, the hanger 4 also can be disposed on the other positions of the bottom 1 and lid 2.

The lid 2 is provided with a through hole 21 for the handle 52 of the iron 5 extending out.

The opening between the two sides and front portion of the bottom 1 and the two sides and front portion of the lid 2 is connected by the zip-fastener 3. Certainly, the opening also can be disposed in the other positions of the bottom 1 or lid 2, preferably, the size of the opening configured to allow the iron 5 in and out.

Figure 2:
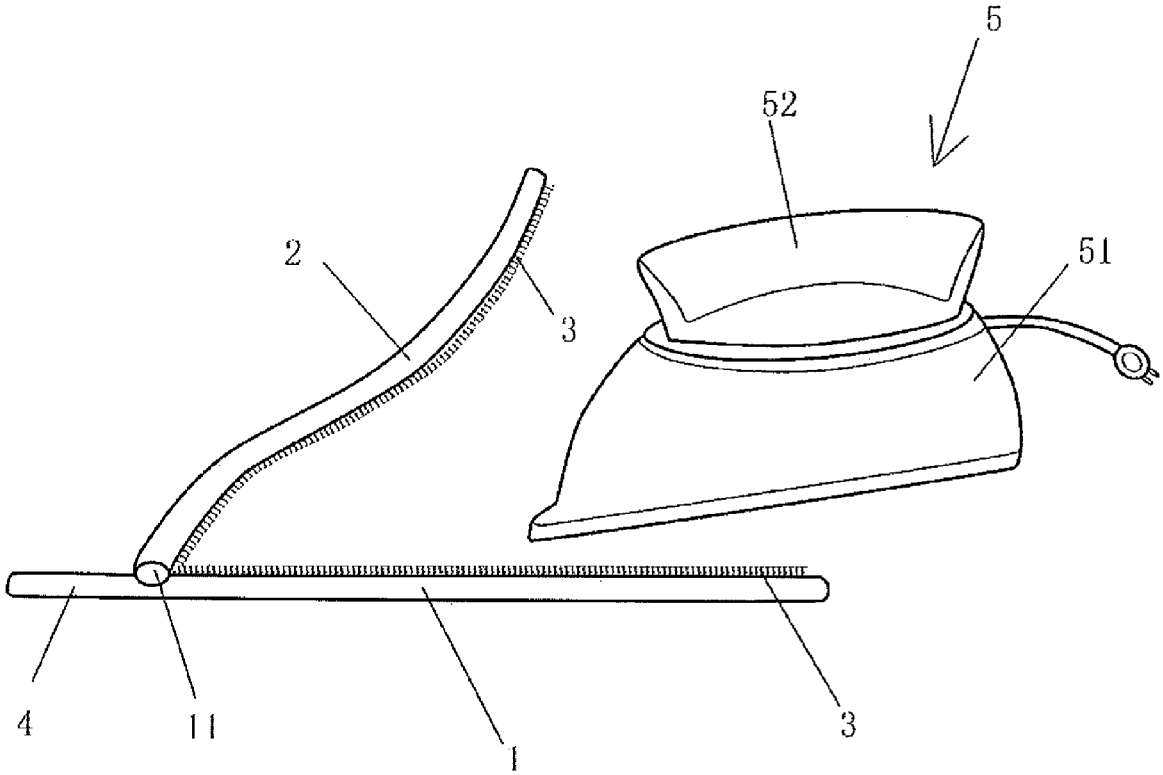
FIG. 2 is a side view illustrates an iron putting into the insulation cover in the embodiment of FIG. 1.
Figure 3:
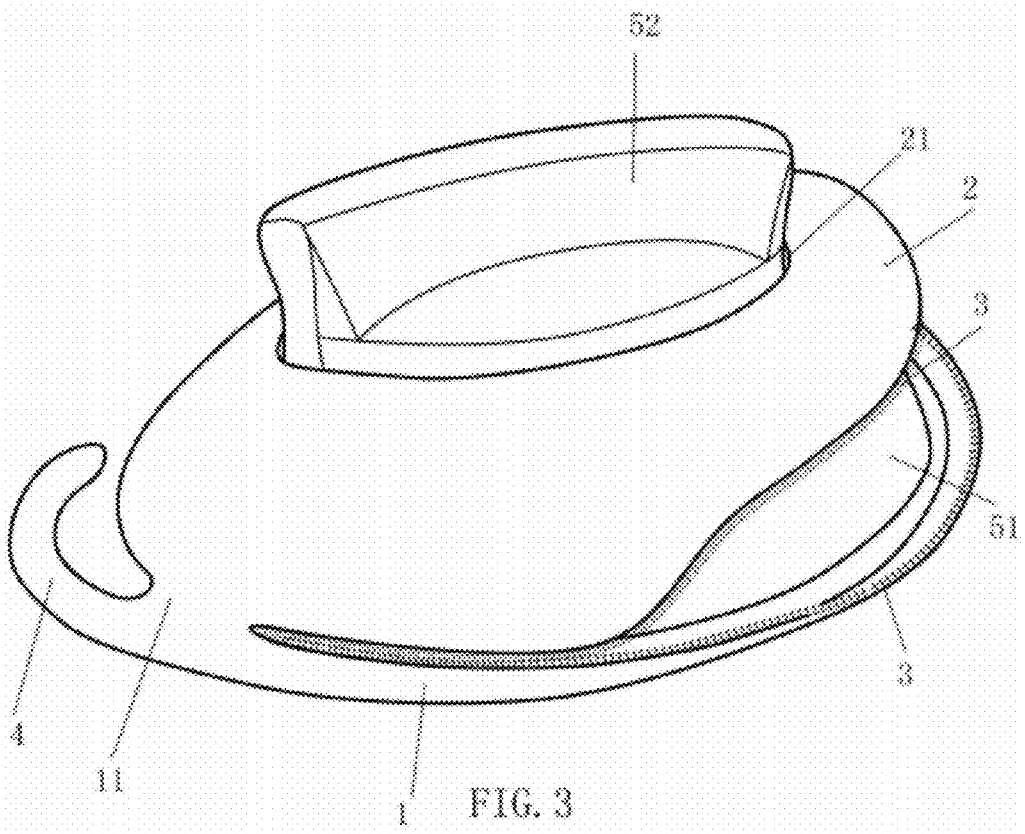
FIG. 3 is a perspective view illustrates an iron putting into the insulation cover in the embodiment of FIG. 1.

The use way of the present invention will be best understood with reference to FIG. 2 and FIG. 3:

Put the bottom 1 of the body on a horizontal surface, unzip the zip-fastener 3 and lift the lid 2, insert the iron 5 into the concave of the bottom 1. Then covered the lid 2, and let the handle 52 of the iron 5 extend out the through hole 21 of the lid 2. Zip up the zip-fastener 3 so that the iron 5 will be enclosed in the bottom 1 and lid 2.

Figure 4:
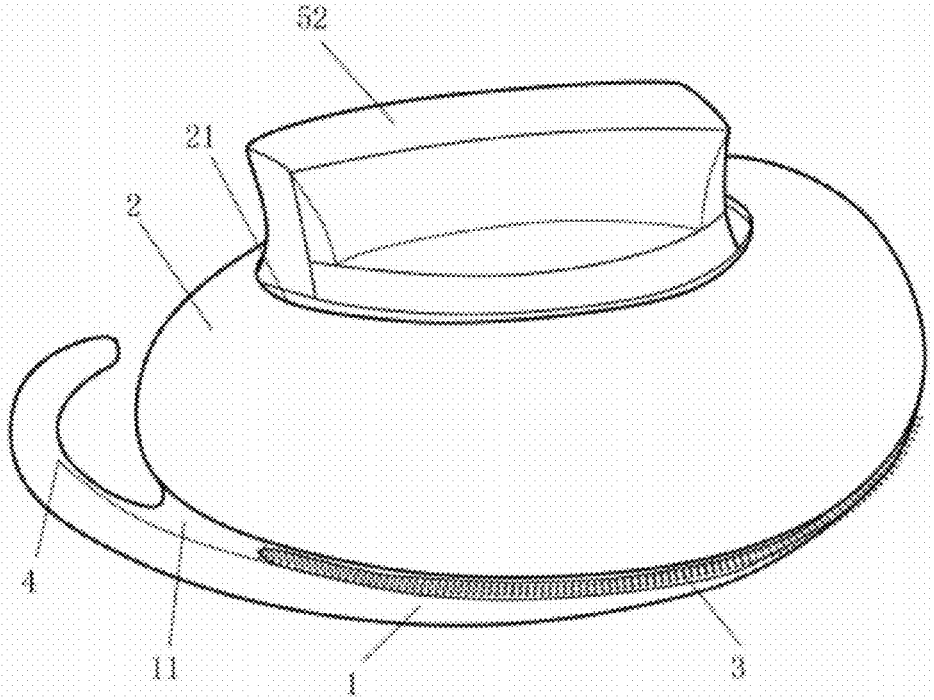
FIG. 4 is a perspective view illustrates that an iron has been put into the insulation cover in the embodiment of FIG. 1.

Then referring to FIG. 4, the iron is stored in a horizontal surface within the insulation cover, thus it will not damage the other goods near it. Because the handle 52 of the iron 5 does not occupy the entire through hole 21 of the lid 2, the heat of the iron 5 can be dissipated from the through hole 21.

Figure 5:
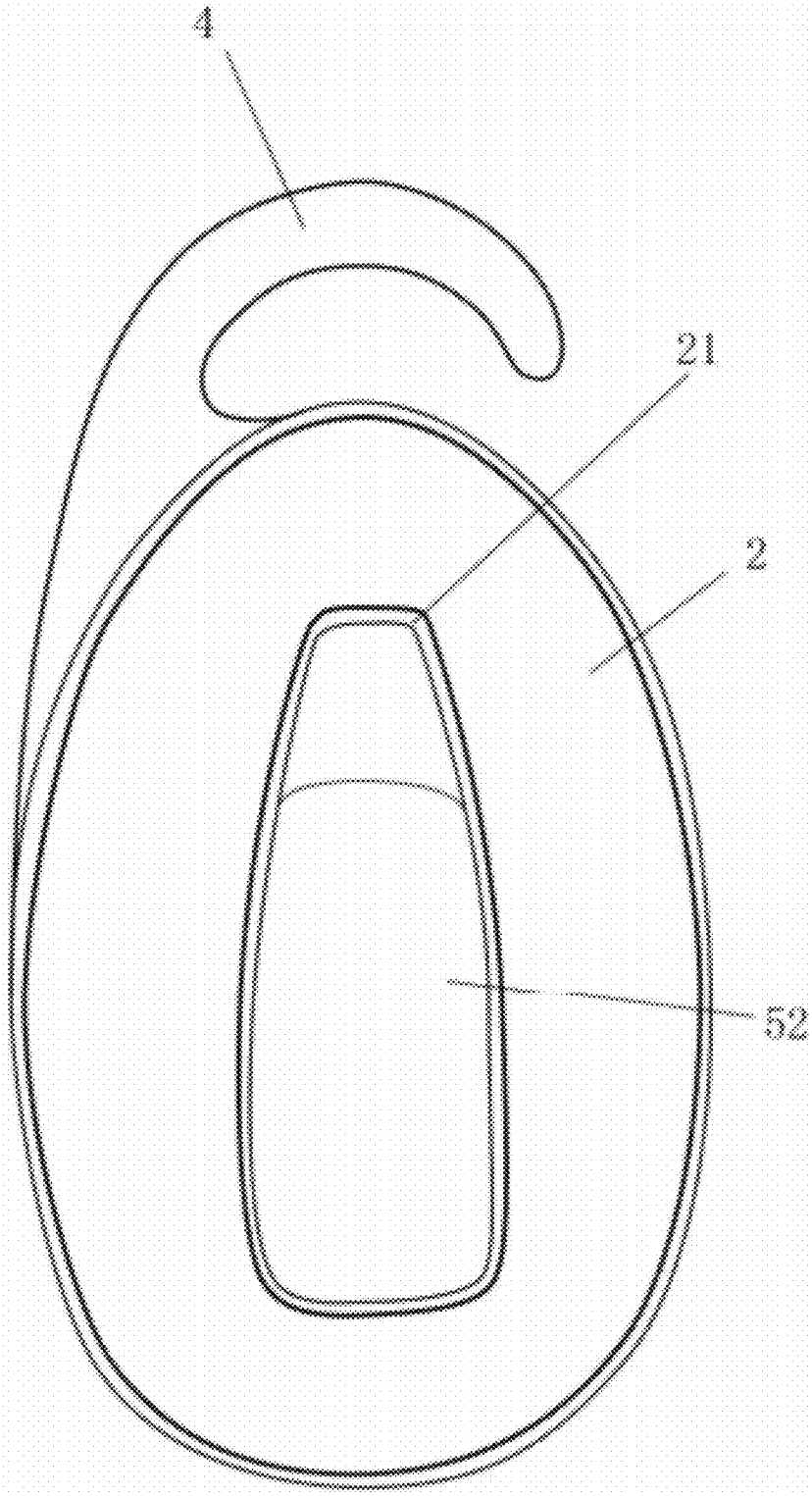
FIG. 5 illustrates the insulation cover in the embodiment of FIG. 1 which is hanged with an iron inside.

Or the iron 4 is hanged to a cross bar within the insulation cover by hanger 4, as is shown in FIG. 5

Thereafter, if the iron 5 is to be used, unzip the zip-fastener 3, lift the lid 2, and withdraw the handle 52 of the iron 5 from the through hole 141 of the lid 2, then the iron can be hold up and taken out from the concave of the bottom 1.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An insulation cover for an iron, comprising:

a main body provided with a hanger and an opening for containing the iron, the opening including a zip-fastener, the main body including a concave bottom and a lid, a rear portion of the concave bottom being connected with a rear portion of the lid, the zip-fastener connecting two sides and a front portion of the lid with two sides and a front portion of the concave bottom;

wherein the hanger is disposed on a connected portion of said concave bottom and said lid.

2. An insulation cover for an iron, comprising:

a main body provided with a hanger and an opening for containing the iron, the opening including a zip-fastener, the main body including a concave bottom and a lid covering the concave bottom, the lid being provided with a through hole to allow a handle of the iron to extend therethrough;

wherein an iron supporting surface of the concave bottom has a plurality of bumps or embossed strips upon which the iron rests to form a space between a bottom surface of the iron and the concave bottom.

* * * * *